US006277015B1

(12) United States Patent
Robinson et al.

(10) Patent No.: US 6,277,015 B1
(45) Date of Patent: Aug. 21, 2001

(54) POLISHING PAD AND SYSTEM

(75) Inventors: Karl M. Robinson; Michael A. Walker, both of Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/300,007

(22) Filed: Apr. 26, 1999

Related U.S. Application Data

(62) Division of application No. 09/013,742, filed on Jan. 27, 1998.

(51) Int. Cl.[7] ..... B24D 11/00

(52) U.S. Cl. ..... 451/528; 451/285; 451/296

(58) Field of Search ..... 451/527, 528, 451/530, 534, 539, 548, 550, 285–290, 296

(56) References Cited

U.S. PATENT DOCUMENTS

| | | | | |
|---|---|---|---|---|
| 4,037,367 | * | 7/1977 | Kruse | 51/209 S |
| 4,142,334 | * | 3/1979 | Kisch et al. | 51/395 |
| 4,869,779 | * | 9/1989 | Acheson | 156/636 |
| 5,015,266 | * | 5/1991 | Yamamoto | 51/293 |
| 5,020,283 | | 6/1991 | Tuttle . | |
| 5,243,790 | * | 9/1993 | Gagne | 51/209 R |
| 5,297,364 | | 3/1994 | Tuttle . | |
| 5,489,235 | * | 2/1996 | Gagliardi et al. | 451/527 |
| 5,547,417 | | 8/1996 | Breivogel et al. . | |
| 5,690,540 | * | 11/1997 | Elliott et al. | 451/41 |
| 5,759,917 | | 6/1998 | Grover et al. . | |
| 5,788,560 | * | 8/1998 | Hashimoto et al. | 451/288 |
| 5,827,781 | | 10/1998 | Skrovan et al. . | |
| 5,921,855 | * | 7/1999 | Osterheld et al. | 451/527 |
| 6,039,633 | * | 3/2000 | Chopra | 451/41 |

* cited by examiner

*Primary Examiner*—Timothy V. Eley
*Assistant Examiner*—Dung Van Nguyen
(74) *Attorney, Agent, or Firm*—Workman, Nydegger & Seeley

(57) ABSTRACT

The present invention comprises a method of chemical-mechanical polishing of a surface on a semiconductor substrate by providing a fixed-abrasive polishing pad; providing a surface to be polished; and providing a chemical polishing solution containing a surface tension-lowering agent that lowers the surface tension of the solution from the nominal surface tension of water to a surface tension that sufficiently wets a hydrophobic surface to be polished such that chemical-mechanical polishing is accomplished. The present invention also comprises pad improvements that mechanically sweep the polishing solution under the pad or that receive polishing solution from the back of the pad such that a tangential and radial shear is placed on the polishing solution as it flows away from the pad.

35 Claims, 6 Drawing Sheets

POLISHING PAD AND SYSTEM

RELATED APPLICATIONS

This is a divisional U.S. patent application Ser. No. 09/013,742, filed on Jan. 27, 1998, titled "CHEMICAL-MECHANICAL POLISHING OF HYDROPHOBIC MATERIALS BY USE OF INCORPORATED—PARTICLE POLISHING PADS", which is incorporated herein by reference.

BACKGROUND OF THE INVENTION

1. The Field of the Invention

The present invention relates generally to chemical-mechanical polishing (CMP) of a semiconductor substrate. In particular, the present invention relates to improving the wetting capability of polishing solutions for fixed-abrasive CMP of hydrophobic surfaces on a semiconductor substrate without compromising the chemical action of the polishing solution. The present invention also comprises a CMP pad that mechanically draws or forces polishing solution between a hydrophobic surface to be polished and a hydrophobic fixed-abrasive polishing pad.

2. The Relevant Technology

In the microelectronics industry, a substrate refers to one or more semiconductor layers or structures which includes active or operable portions of semiconductor devices. In the context of this document, the term "semiconductor substrate" is defined to mean any construction comprising semiconductive material, including but not limited to bulk semiconductive material such as a semiconductive wafer, either alone or in assemblies comprising other materials thereon, and semiconductive material layers, either alone or in assemblies comprising other materials. The term "substrate" refers to any supporting structure including but not limited to the semiconductor substrates described above. A semiconductor device refers to a semiconductor substrate upon which at least one microelectronic device has been or is being batch fabricated.

In conventional CMP technology a slurry is distributed between a resilient pad and the surface to be polished. In conventional slurried CMP technology, the surface tension of the liquid is not of great concern because slurry particulates have a trajectory within the polishing area, such that the particulates will impact the surface, regardless of the hydrophobicity of the surface to be polished and the surface tension of the polishing liquid.

In a conventional CMP apparatus, a semiconductor substrate to be polished is mounted on a polishing block which is placed on the CMP machine. A polishing pad is adapted to engage the semiconductor substrate carried by the polishing block. A cleaning agent is dripped onto the pad continuously during the polishing operation while pressure is applied to the semiconductor substrate.

A typical CMP apparatus comprises a rotatable polishing platen and a polishing pad mounted on the platen. Platen and pad are typically driven by a microprocessor controlled motor to spin at about 0 to about 200 RPM. A semiconductor substrate is mounted on a rotatable polishing head so that a major surface of the semiconductor substrate to be polished is positionable to contact the polishing pad. The semiconductor substrate and polishing head are attached to a vertical spindle that is rotatably mounted in a lateral robotic arm that rotates the polishing head at about 0 to about 50 RPM in the same direction as the platen and radially positions the polishing head. The robotic arm also vertically positions the polishing head to bring the semiconductor substrate into contact with the polishing head and maintain an appropriate polishing contact pressure A tube opposite the polishing head above the polishing pad dispenses and evenly saturates the pad with an appropriate cleaning agent, typically a slurry. The slurry-assisted polishing pad is typically porous, which favors wetting of the polishing surface.

Other CMP techniques include orbiting or oscillating motions of either the article to be polished or of the polishing pad, or both. Other CMP techniques include a belt-shaped polishing pad that is advanced translationally under the article to be polished, and the article to be polished is rotated, oscillated, or both across the surface of the belt-shaped pad.

In fixed-abrasive CMP technology, a polishing solution is distributed between a resilient resin pad containing abrasives and the surface to be polished. The pad can be made from substances that are hydrophobic. These substances include amines, organic polymers, and resins. In conventional polishing of oxide surfaces the aqueous polishing solution sufficiently wets the oxide surface because water is also an oxide and the surface tension between the two is sufficiently low that the solution wets the oxide surface.

CMP of hydrophobic surfaces includes substances such as monocrystalline silicon, HSG silicon, amorphous silicon, polycrystalline silicon (polysilicon), silicides such as tungsten and titanium silicide, interlayer dielectrics such as PTFE and refractory pure metals or alloys such as tungsten, titanium, and copper.

Conventional CMP of hydrophobic surfaces with fixed-abrasive pads that are likewise hydrophobic presents a challenge to keep a uniformly-wetted surface where polishing is done with an aqueous solution. Between the two hydrophobic surfaces of the fixed-abrasive pad and the surface to be polished, there exists no surface that wets easily. This resistance to wetting hinders uniform coverage of the polishing solution. Attempting to force an aqueous polishing solution between two hydrophobic surfaces results in the formation of aqueous solution beads at the perimeter of the pad and no chemical action occurs. With no chemical action, polishing is ineffective and CMP fails. The result is that the surface to be polished is scratched and the semiconductor substrate is damaged or destroyed.

In the chemical makeup of the polishing solution for hydrophobic semiconductor surfaces, two factors of sufficient wetting and sufficient chemical action are required. In fixed-abrasive CMP of hydrophobic surfaces, sufficient chemical action requires a balance between sufficient chemical polishing and sufficient chemical selectivity that achieves both CMP of hydrophobic surfaces and stopping on nonhydrophobic surfaces. Additionally, where CMP is carried out within a single film, although chemical selectivity is not an issue, there remains the requirement of achieving sufficient wetting and sufficient chemical action.

FIG. 1 depicts the wetting of a polishing solution on a surface to be polished. In the droplet of moisture, an angle known as θ, or the contact angle, forms between the plane of the solid surface to be wetted and the slope of the liquid contacting the solid surface. In describing the forces at a solid-liquid-gas interface 12, three surface tensions must balance in a static situation. The surface tension between the solid and the gas, $\gamma_{sg}$, is usually very small. In FIG. 1 the surface tension of the solid and gas, $\gamma_{sg}$, is depicted as a vector 14 at the solid-liquid-gas triple point. The surface tension of the solid and liquid, $\gamma_{sl}$, is depicted as a vector 16 at the triple point. The surface tension of the liquid and the gas, $\gamma_{lg}$, is depicted as a vector 18 that forms an angle, θ with the solid surface. A force balance around the triple point reveals that $$\gamma_{sl}=\gamma_{lg}\cos\theta+\gamma_{sg} \quad (1)$$

This expression can be rearranged to be solved for the contact angle θ as $$\cos\theta=(\gamma_{sl}-\gamma_{sg})/\gamma_{lg}. \quad (2)$$

FIG. 2 illustrates the interplay between surface tension of the liquid in the gas and surface tension of the solid in the liquid where the surface tension of the solid is held constant. If the surface tension of the liquid in the gas is high, an acute angle, $\theta_1$ is formed and the surface of the solid is called hydrophobic. If the surface tension of the solid in the liquid exactly equals the surface tension of the solid in the gas then the contact angle is a right angle, $\theta_2$ and the surface of the solid is neutral to hydrophobicity or hydrophilicity. If the surface tension of the liquid in the gas is low enough an obtuse angle $\theta_3$ is formed and the surface of the solid is called hydrophilic. Equation 2 does not hold, however when complete wetting occurs such that $\theta_3$ is 180 degrees and $\gamma_{sg}>\gamma_{sl}+\gamma_{lg}$, or for no wetting at all such that $\theta_1$ is zero degrees and $\gamma_{sl}>\gamma_{sg}+\gamma_{lg}$.

FIG. 3 illustrates the inadequate wetting problem of the prior art. In FIG. 3 a semiconductor substrate 200 has been patterned and etched through an oxide or nitride layer 202 to form a trench or hole 204 in a silicon substrate 206. Upon oxide or nitride layer 202 a polysilicon layer 208 is deposited that fills trench or hole 204 and covers the entire upper surface of oxide or nitride layer 202. To form a contact, polysilicon layer 208 is illustrated as being polished with a fixed-abrasive CMP pad 210 and the surface is being wetted with a polishing solution 112. Due to the hydrophobicity of both pad 210 and polysilicon layer 208 polishing solution 112 forms acute contact angles at the edge of pad 210 and polishing solution 112 is not drawn under pad 210 such that the chemical aspect of CMP is not accomplished.

FIG. 4 depicts section 4—4 taken from FIG. 3 in which a closer view of failed wetting of the polishing solution on a hydrophobic surface is illustrated. In FIG. 4 it is illustrated that the contact angle θ is acute such that polishing solution 112 is not drawn under pad 210. Because polishing solution 112 is not drawn under pad 210, wetting does not occur between pad 210 and polysilicon layer 208, and therefore CMP is not accomplished.

What is needed is a polishing solution, in combination with chemical polishing parameters, that wets either the fixed-abrasive pad or the polishing surface sufficiently to activate CMP without altering the necessary chemical composition of the polishing solution to the point that it no longer serves its role in the chemical portion of CMP. What is alternatively needed is a fixed-abrasive pad that, although flexible and resilient, is physically configured such that wetting across the pad is sufficient to transfer the polishing solution uniformly across the surface to be polished to activate the entire CMP process.

In connection with a polishing solution that will uniformly wet a hydrophobic surface to be polished, what is also needed is a polishing solution that will not continue its CMP action if the surface were one where it is effaced down to a hydrophilic surface such as an oxide.

SUMMARY OF THE INVENTION

The present invention comprises a method of CMP of hydrophobic surfaces with hydrophobic fixed-abrasive polishing pads that comprises providing a fixed-abrasive polishing pad and hydrophobic surface to be polished such as a polysilicon surface. A CMP solution is provided that contains enough surfactant to lower the surface tension of the polishing solution, from the nominal 72 dynes per centimeter of water, to a range of from about 20 to 50 dynes per centimeter. The preferred surfactant does not, however, compromise the requisite chemistry of the polishing solution such that the CMP effect remains. The preferred surfactant is selected from the group of anionic, cationic, or non-ionic surfactants, depending upon the specific application that takes into account CMP chemistry and the type of hydrophobic surfaces involved. The preferred surfactant may also be a plurality of surfactants that are provided in the polishing solution in sequence in order to achieve a preferred chemical action as the surface to be polished changes due to wearing down.

The present invention also comprises balanced chemical activity and stop-on a selected layer action of the polishing solution in addition to wetting of hydrophobic surfaces.

The present invention also comprises a CMP pad that entrains liquid at a rotating perimeter thereof and mechanically draws liquid thereunder such that chemical contact with an hydrophobic surface is accomplished by shearing forces of the pad upon the polishing liquid. The present invention also comprises a belt-type CMP pad that entrains liquid at the perimeter of a rotating polishing platen and mechanically draws liquid thereunder such that chemical contact with an hydrophobic surface is accomplished by shearing forces of the pad upon the polishing liquid. The present invention also includes a CMP pad that supplies polishing solution to the center of the pad by a pumping action such that fresh polishing fluid first contacts the hydrophobic surface to be polished at the center of the pad, and then the polishing fluid moves both tangentially and radially as more polishing fluid displaces that which contacts the surface to be polished.

These and other features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
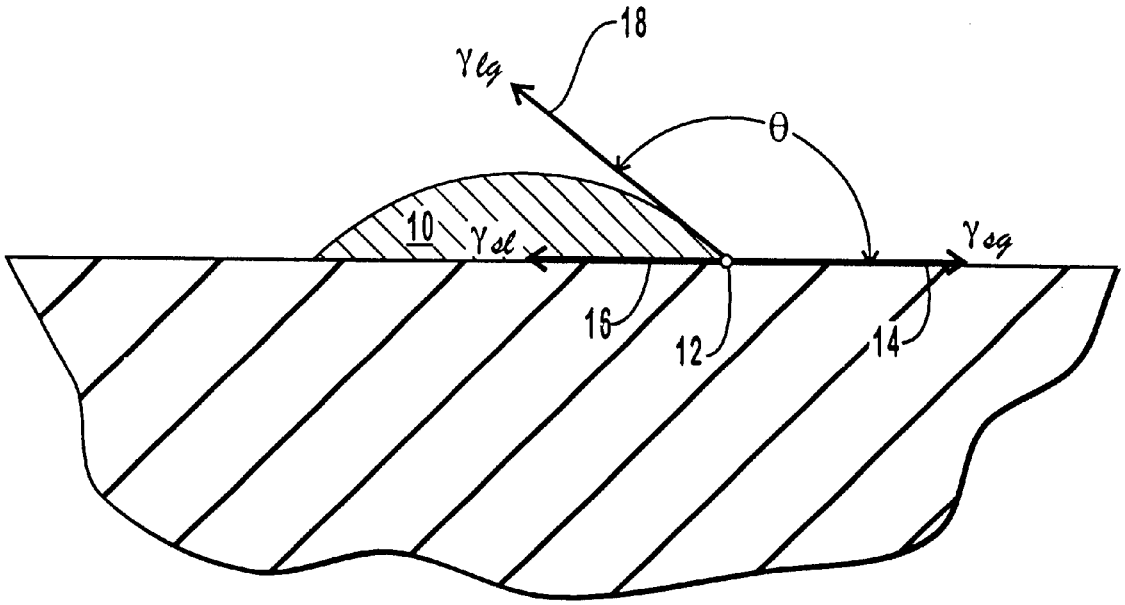
FIG. 1 is an elevational cross-section view of surface tension in stasis at a solid-liquid-gas interface.
Figure 2:
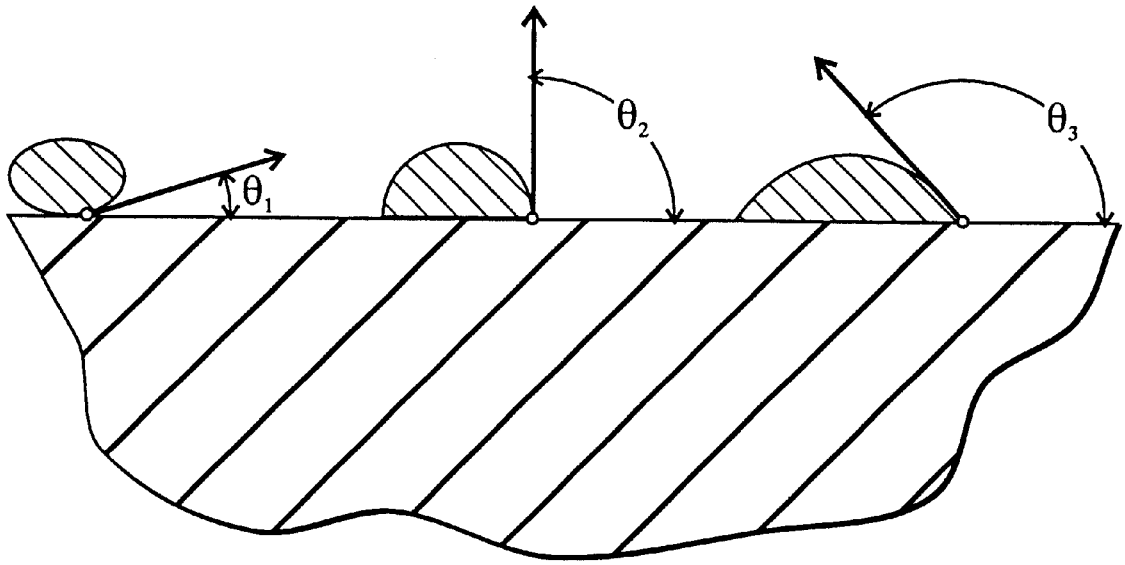
FIG. 2 is an elevational cross-section view of polishing solutions of three varying surface tensions upon a given surface.
Figure 3:
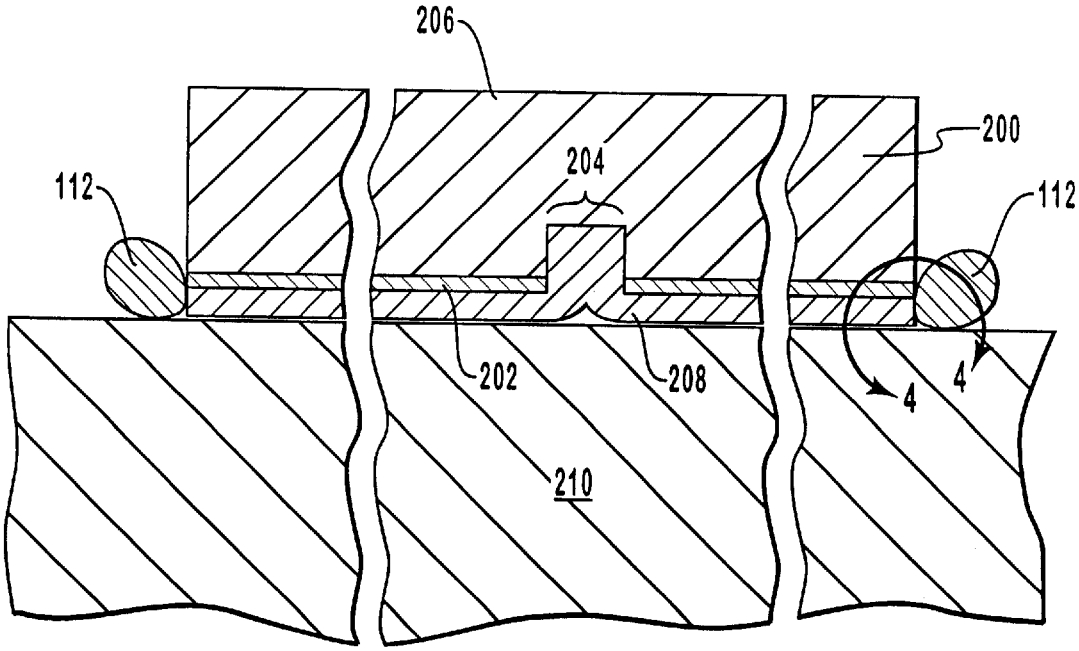
FIG. 3 (PRIOR ART)
FIG. 3 is an elevational cross-section view of the non-wetting problem that occurs with fixed-abrasive pads and hydrophobic surfaces to be polished.
Figure 4:
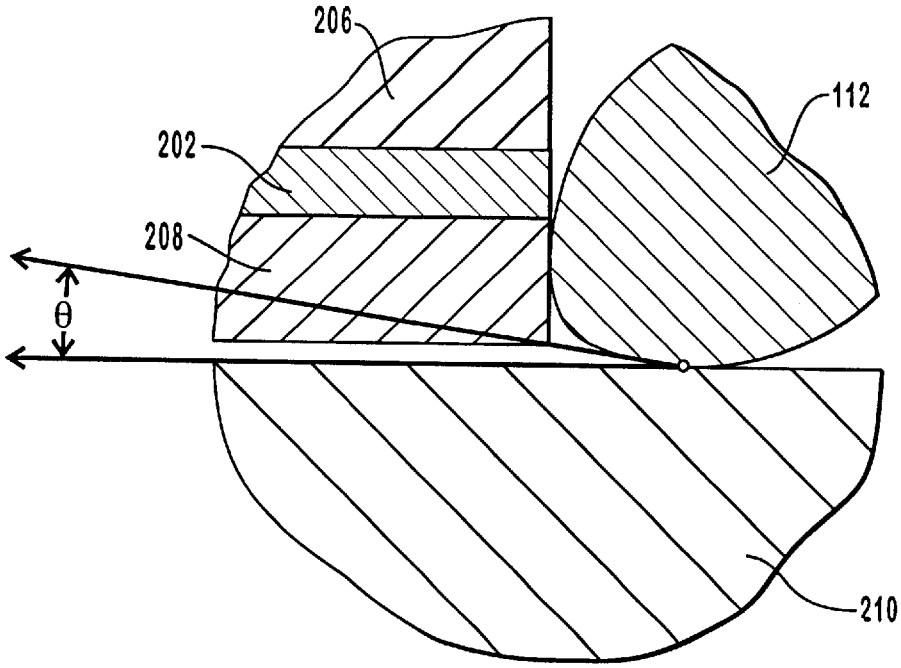
FIG. 4 (PRIOR ART)
FIG. 4 is a detail section taken from FIG. 3 in which the polishing solution contact angle is illustrated.

Advantages of the present invention will become readily apparent to those skilled in the art to which the invention pertains from the following detailed description, wherein preferred embodiments of the invention are shown and described in the disclosure by way of illustration of the best mode contemplated for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

The present invention involves fixed-abrasive CMP of hydrophobic surfaces such as polysilicon on a semiconductor substrate. The present invention is also drawn to fixed-abrasive CMP of non-hydrophobic surfaces that can have enhanced CMP action due to lower surface tension of the polishing solution.

During fixed-abrasive CMP of hydrophobic surfaces on a semiconductor substrate, the method of the present invention lowers the surface tension of the polishing solution to the point that the solution sufficiently wets the hydrophobic surface to be polished without compromising the necessary chemistry required to accomplish CMP.

Fixed-abrasive pads may contain abrasives such as ceria ($CeO_2$), silica ($SiO_2$), or alumina ($Al_2O_3$) among others that are well known in the art. The pads are comprised of such materials as organic polymers and the pads may have raised topographical features for optimum polishing. In the method of the present invention a polysilicon surface, for example, is to be polished by fixed-abrasive pad CMP and the CMP process may stop on an underlying hydrophilic layer, for example an oxide layer.

An example of the above-mentioned method is in the forming of polysilicon contacts in a semiconductor substrate. In this example the semiconductor substrate has been trench or hole etched. Polysilicon has been deposited into the trench or hole, and the CMP method of the present invention is employed to remove all polysilicon that has not been deposited into the trench or hole. Such a CMP technique requires sufficient lowered surface tension of the polishing solution that wetting of the polysilicon occurs. The chemistry of the polishing solution, however, cannot have been compromised such that it cannot accomplish both the chemical aspect of CMP and remain selective enough to stop on an underlying layer if a stop-on-layer method is being used.

Without a surfactant that lowers the surface tension of the polishing solution of the present invention, the polishing solution will fail to wet the surface to be polished and the fixed-abrasive pad will merely scratch the surface to be polished until it is destroyed. Preferred surfactants are selected from the group consisting of anionic, cationic, and nonionic surfactants, their combinations in part or in whole, and the mixture products thereof. A preferred surfactant chemistry is selected according to the specific application. For example, when the polishing pad is of a certain chemical makeup, the polishing solution that works well in combination with such a polishing pad may require a nonionic surfactant because the polishing solution is not compromised with a nonionic surfactant. In this example, a nonionic surfactant would be required because the polishing chemistry would be adversely affected by an anionic or a cationic surfactant.

Additionally, a selected polishing solution may be contacted with a surface to be polished and the preferred surfactant may be changed when appropriate, for example, from anionic to cationic. Such an application is to be used, for example, where a first surface to be polished is worn down to expose a second surface and wetting characteristics and the chemistry of the polishing solution favor changing the surfactant.

In the present invention, methods of overcoming failed CMP where hydrophobic fixed-abrasive pads are being used and where a hydrophobic surface is to be polished, comprise altering the surface tension of the polishing solution or providing a fixed abrasive pad that is hydrophilic, or both. Methods of the present invention also include embossing the pad with patterns that entrain the polishing solution at the periphery of the pad and tend to physically draw the polishing solution toward the center of the pad if it is a circular polishing pad.

Typical polishing solutions are dilute KOH or ammonium hydroxide solutions for basic solutions. For acidic polishing solutions, $KIO_3$, potassium pthalate, phthalic acid, or equivalents can be used. The pH of the specific solution depends upon the surface to be polished, for example polysilicon surfaces are polished better under caustic conditions and metal surfaces such as tungsten or other refractory metals are polished better in acidic conditions. For example with a tungsten metallization layer, polishing with the use of potassium periodate or with a peroxide solution will form tungsten oxide that is more easily mechanically stripped away by the CMP pad.

In addition to hydrophobic silicon and metal surfaces, dielectric polymers that are used as interlayer dielectrics between metallization lines can also be polished by CMP using the method of the present invention in which the hydrophobicity of the polymers is overcome by lowering the surface tension of the polishing solution.

In addition to pH qualities for various polishing solutions, selectivity to oxide or nitride over a pure silicon, a metal, a polymer, or a silicide must be achieved. Surface tension lowering in the present invention comprises adding a surfactant to the polishing solution in order to lower the surface tension from the nominal 72 dynes/cm for pure water to a range from about 20 dynes/cm to about 50 dynes/cm. When a hydrophilic pad that is made from material such as polyvinyl alcohol (PVA) is used as the fixed-abrasive pad, the surface tension lowering need not be as marked as when a hydrophobic pad is used as the fixed-abrasive pad.

With a hydrophobic fixed-abrasive pad, a surface tension in a range from about 20 dynes/cm to about 50 dynes/cm is preferred, with a range from about 20 dynes/cm to about 40 dynes/cm more preferred, and a range from about 20 dynes/cm to about to about 35 dynes/cm most preferred. With a hydrophilic or a less hydrophobic pad used as the fixed-abrasive pad, a higher surface tension is allowable for an equivalent CMP effect on the same surface and the preferred range is dependent upon allowable CMP solution chemistry for a given surface to be polished.

Figure 5:
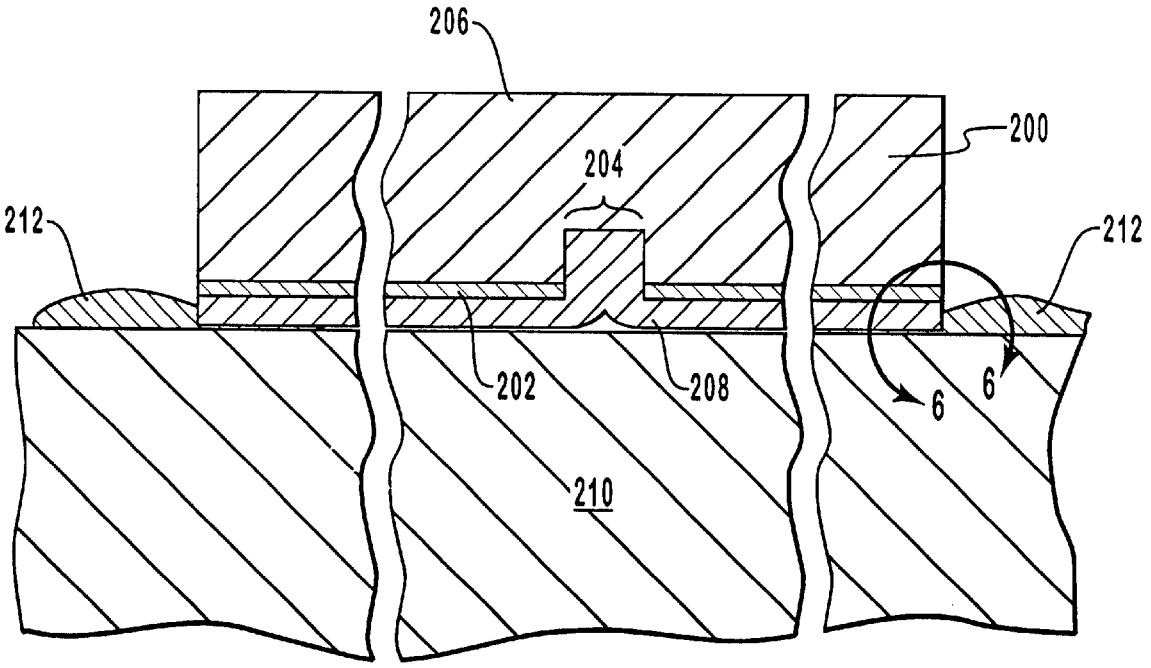
FIG. 5 is a cross-section depiction of a fixed-abrasive CMP of the present invention being applied to form a contact structure wherein the surface tension of the polishing solution is such that an oblique contact angle is formed.

FIG. 5 illustrates a first embodiment of the method of the present invention in which polishing solution 212 has been modified with a surfactant that lowers surface tension so as to provide adequate wetting with the method of the present invention. In FIG. 5 a semiconductor substrate 200 has been patterned and etched through an oxide or nitride layer 202 to form a trench or hole 204 in a silicon substrate 206. Upon oxide or nitride layer 202 a polysilicon layer 208 is deposited that fills trench or hole 204 and covers the entire upper surface of oxide or nitride layer 202. To form a contact, polysilicon layer 208 is illustrated as being polished with a fixed-abrasive CMP pad 210 and the surface is being wetted with a polishing solution 212. In spite of the hydrophobicity of both pad 210 and polysilicon layer 208, polishing solution 212 is drawn under pad 210 as is better seen in FIG. 6. As such, the chemical aspect of CMP is accomplished.

Figure 6:
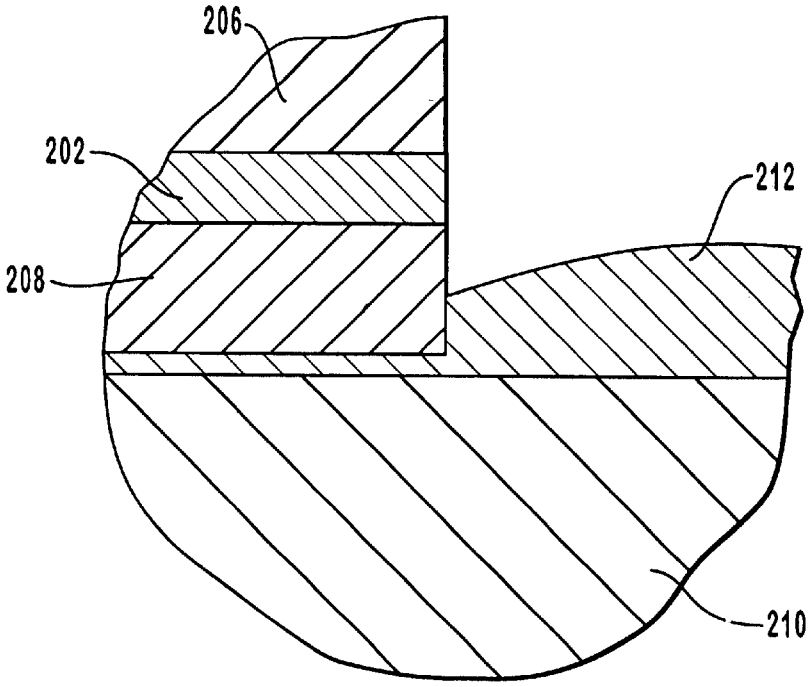
FIG. 6 is a detail section taken from FIG. 5 in which the polishing solution wetting of the hydrophobic surface to be polished is illustrated.

FIG. 6 depicts a section 6—6 taken from FIG. 5 in which a closer view of wetting of the polishing solution on a hydrophobic surface is illustrated. In FIG. 6 it is illustrated that the polishing solution 212 is drawn under pad 210. Because polishing solution 212 is drawn under pad 210 wetting occurs between pad 210 and polysilicon layer 208 and therefore CMP is accomplished.

Figure 7:
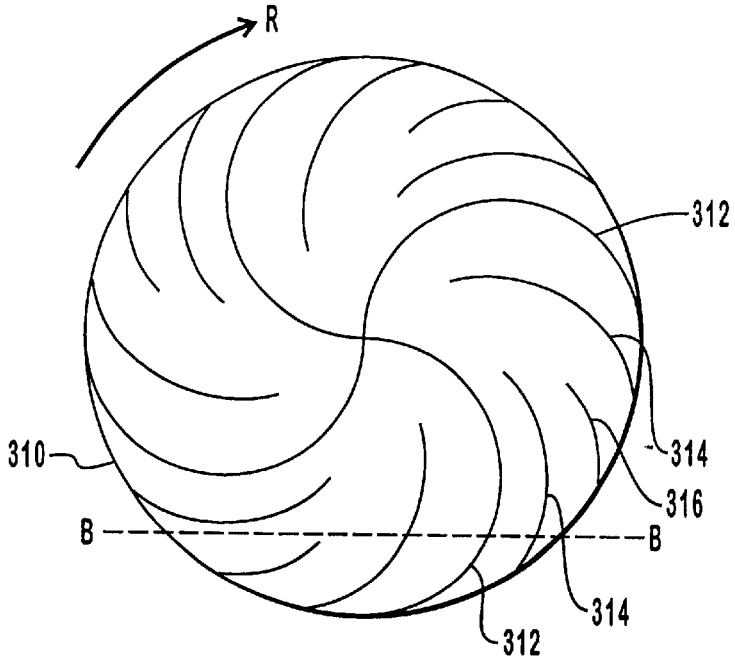
FIG. 7 is a plan view illustrating a polishing pad that is embossed in a spiral or pinwheel configuration and rotated in a direction so as to entrain liquids at the perimeter thereof and to draw the liquids toward the center of the rotating pad.

FIG. 7 illustrates an alternative embodiment of the method of the present invention in which pad 310 is embossed in a spiral or pinwheel configuration and rotated in a direction R so as to entrain liquids at the perimeter and to draw them toward the center of the rotating pad. Pad 310 can be patterned by rolling a heat-softened pad material through an embosser.

Figure 8:
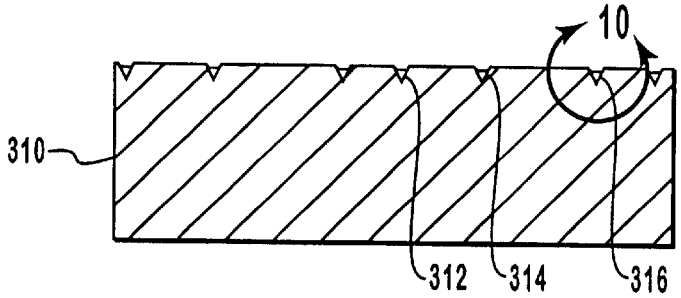
FIG. 8 is an elevational cross-section view of FIG. 7 taken along the line B—B for depressed lines.
Figure 9:
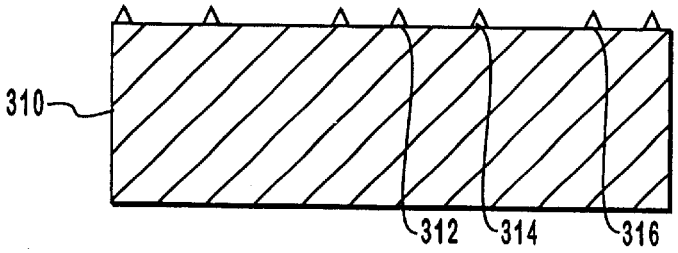
FIG. 9 is an elevational cross-section view of FIG. 7 taken along the line B—B for raised lines.

FIGS. 8 and 9 are cross-sectional views of FIG. 7 taken along the line B—B for depressed and raised lines, respectively. Patterning can leave depressed or concave, channel-like lines 312, 314, 316 as seen in FIG. 8. Patterning can also leave either raised or convex, vane-like lines 312, 314, 316 as seen in FIG. 9.

Although FIG. 7 depicts only three distinct lengths of channels or raised lines, 312, 314, and 316, it is within the skill of the ordinary artisan to pattern pad 310 with a plurality of lines in the same longer-to-shorter configuration as lines 312–316. Total line density is limited by factors of wetting inside channels and by line intersectings as they approach the pad center such that a surplus of lines will result in either a large pit at pad center for channels, or in a high spot at pad center where a surplus of raised lines intersect.

In addition to rotating pad 310 depicted in FIG. 7, pad 310 can be stationary and a semiconductor substrate can be rotated against the surface of pad 310 as well as moved in an orbital motion across the face of pad 310 in a manner that will maximize the polishing solution entrainment qualities of pad 310, namely channels or raised lines 312, 314, and 316.

Figure 10:
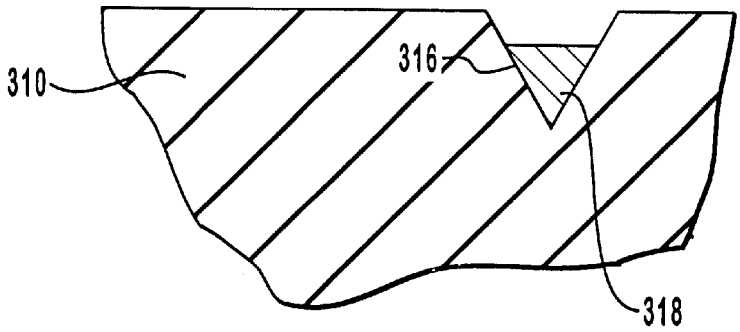
FIG. 10 is a detail section from FIG. 8 taken along the line 10—10.

FIG. 10 is a section 10 taken from FIG. 8. With channel-like lines a hydrophilic substance 318 can be inlaid in the channel seen in FIG. 10 so as to lie in the channel bottom. This will cause the polishing solution to wet along the channel bottom and draw polishing solution toward the center of the polishing pad due to the pad's rotational movement. Hydrophilic substance 318 can be deposited in pad 310 by any of several techniques known to the ordinary artisan such as a macroscopic photoresist. Hydrophilic substance 318 can also be deposited by doctor blading a fill material into channel-like lines 312, 314, 316 and curing the fill material to form hydrophilic substance 318.

Figure 11:
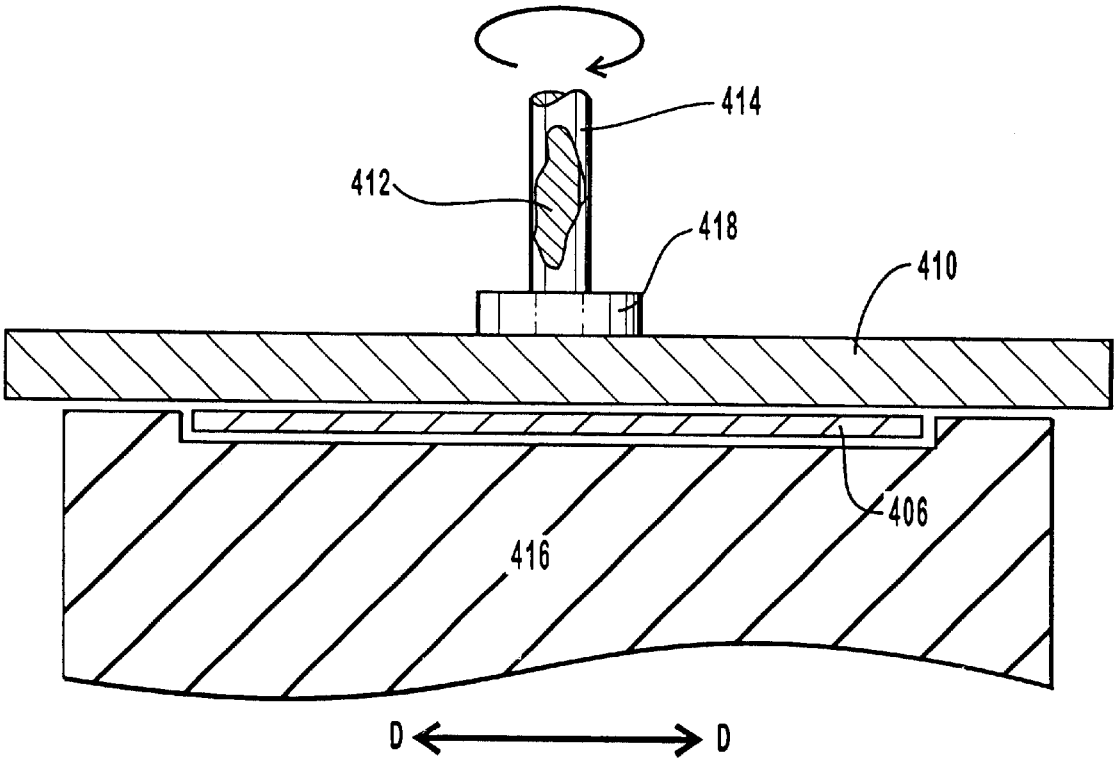
FIG. 11 is a front elevational view of an embodiment of a preferred pad in which a semiconductor substrate to be polished rests in a jig that is oriented face-up such that the semiconductor substrate rests in the jig by gravity.

FIG. 11 illustrates another embodiment of a preferred pad. In this embodiment a semiconductor substrate to be polished 406 rests in a jig 416. Jig 416 can be oriented face-up such that semiconductor substrate 406 rests in jig 416 by gravity, or it can be held into jig 416 face-down wherein suction holes (not shown) hold semiconductor substrate 406 against jig 416. A polishing solution 412 (cutaway) is pumped through the center of a shaft 414 that both rotates and holds pad 410 against jig 416. Polishing solution 412 passes through the back of pad 410 through a rotatable pressure gland 418 under pressure such that minimal leaking occurs on the side of pad 410 that is not abutting against semiconductor substrate 406.

Polishing solution 412 dispenses through the center of pad 410 and flows across the face of semiconductor substrate 406 under pressure and under shear. As the polishing solution is under pressure it is pressed against the hydrophobic surface to be polished and wets the surface because of the pressure. As the pad rotates across the face of the surface to be polished, shear forces also cause the polishing solution to wet the surface of semiconductor substrate 406.

Pad 410 requires a rotatable pressure gland 418 to allow influx of polishing solution through the back of the pad without detrimental pressure loss. Jig 416 is configured to both oscillate and rotate. Oscillation is depicted by the arrow marked D—D, and oscillation does not allow any portion of jig 416 to become exposed so as to lose polishing solution pressure.

Although pad 410 is illustrated in FIG. 11 as being applied to a single semiconductor substrate, the pad can be large enough to cover a jig that holds a plurality of semiconductor substrates in planetary fashion. In this embodiment pad 410 would be as large as in previous technology but jig 416 would approach the pad size in diameter.

Figure 12:
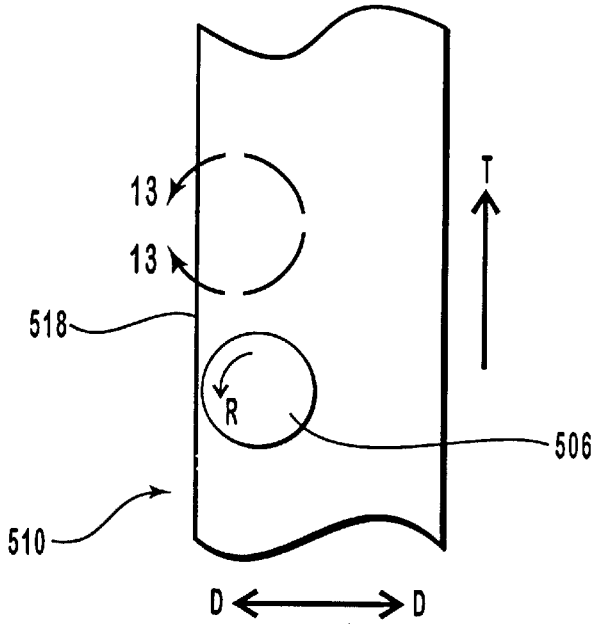
FIG. 12 illustrates a plan view of a belt CMP pad against which a semiconductor substrate is placed and optionally rotated.

FIG. 12 illustrates a belt CMP pad 510 against which a semiconductor substrate 506 is placed and optionally rotated. Pad 510 is moved translationally in the direction T as wear necessitates its movement to present a newer wear surface to semiconductor substrate 506. Semiconductor substrate 506 is also moved translationally in the oscillating direction demarcated D—D in FIG. 12. The combination of translational movement T, rotational movement R, and oscillatory movement, D—D maximize the useful life of pad 510.

Figure 13:
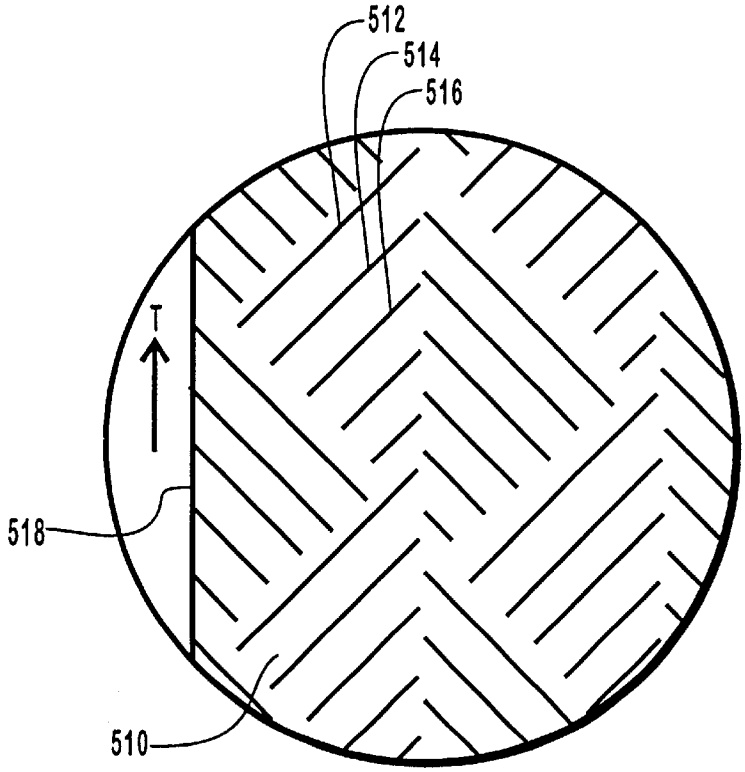
FIG. 13 illustrates a detail section 13—13 taken from FIG. 12 in which a depiction of polishing solution-entraining structures is given.

FIG. 13 illustrates a section 13—13 taken from FIG. 12 in which a depiction of polishing solution-entraining structures on pad 510 is given. It is noted that section 13—13 includes an edge 518 of pad 510. A series of diagonal and decreasing-length structures 512, 514, and 516 are illustrated in staggered fashion upon pad 510. Although only three structures 512, 514, and 516 are depicted and although the pattern is illustrated as a staggered series of diagonal lines it is within the skill of the ordinary artisan to manufacture pad patterns that optimize polishing solution entrainment by the patterns.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. A polishing pad comprising:

a geometric center and a perimeter;

an abrasive material fixed therein;

an external surface including a hydrophilic substance and a plurality of non-planar structures, each said structure extending toward the perimeter and toward the geometric center of the polishing pad.

2. The polishing pad as defined in claim 1, wherein each said structure has a broken arcuate configuration that extends toward the perimeter and toward the geometric center of the polishing pad.

3. The polishing pad as defined in claim 1, wherein each said structure has a length, and wherein the lengths of said plurality of non-planar structures vary.

4. The polishing pad as defined in claim 1, further comprising:

a front surface and a back surface; and a passage way for communication of a liquid between the back and front surfaces.

5. The polishing pad as defined in claim 4, wherein the passage way communicates the liquid between the back and front surfaces at the geometric center.

6. The polishing pad as defined in claim 1, wherein each said structure is at least one of a depressed line and a raised line.

7. The polishing pad as defined in claim 6, wherein each said depressed line has said hydrophilic substance therein.

8. A polishing pad comprising:

a geometric center and a perimeter;

a front surface and a back surface;

a passage way for communication of a liquid between the back and front surfaces at the geometric center;

an abrasive material fixed therein;

an external surface including a plurality of non-planar structures, each said structure having a length and a broken arcuate configuration that extends to the perimeter and toward the geometric center of the polishing pad, wherein the lengths of said plurality of non-planar structures vary.

9. The polishing pad as defined in claim 8, wherein each said structure is at least one of a depressed line and a raised line.

10. The polishing pad as defined in claim 9, wherein each said depressed line has a hydrophilic substance therein.

11. A belt polishing pad comprising:

an endless perimeter;

an abrasive material fixed;

an external surface including a hydrophilic substance and a plurality of non-planar structures, each said structure having a linear configuration that is unparallel with respect to the longitudinal perimeter of the belt polishing pad.

12. The belt polishing pad as defined in claim 11, wherein each said structure is at least one of a depressed line and a raised line.

13. The belt polishing pad as defined in claim 12, wherein each said depressed line has said hydrophilic substance therein.

14. The belt polishing pad as defined in claim 11, wherein said plurality of non-planar structures form a herring bone pattern.

15. The belt polishing pad as defined in claim 11, wherein said plurality of non-planar structures form decreasing-length structures.

16. A polishing system comprising:

a polishing pad having a perimeter, a geometric center, and an external surface thereon, said external surface having therein a plurality of non-planar structures, each said structure having an arcuate configuration that extends toward the perimeter and toward the geometric center of the polishing pad;

a chemical polishing solution having a surface tension, $\gamma_{lg}$, in a range from about 20 dynes/cm to about 50 dynes/cm; and a polishing machine for:

placing the polishing pad in contact with a hydrophobic surface of a semiconductor substrate;

supplying the polishing pad with the chemical polishing solution under pressure at the geometric center of the polishing pad to wet the polishing pad and the hydrophobic surface of the semiconductor substrate with the chemical polishing solution;

moving the semiconductor substrate, the chemical polishing solution, and the polishing pad in mutual contact.

17. The polishing system according to claim 16, wherein the chemical polishing solution has a surface tension, $\gamma_{lg}$, in a range from about 30 dynes/cm to about 40 dynes/cm.

18. The polishing system according to claim 16, wherein said polishing solution flows under a shear-flow path away from said geometric center of said polishing pad.

19. The polishing system according to claim 18, wherein said shear-flow path is tangential and radial.

20. The polishing system according to claim 17, wherein the external surface of the polishing pad has a hydrophilic substance thereon.

21. The polishing system according to claim 16, wherein said plurality of non-planar structures comprise:

a first plurality of structures situated at the perimeter of said polishing pad and extending longitudinally to an intersection thereof at the geometric center of said polishing pad;

a second plurality of structures situated at the perimeter of said polishing pad and being oriented substantially parallel to said first plurality of structures, each structure of said second plurality of structures having a longitudinal length that is shorter than that of each structure of said first plurality of structures; and a third plurality of structures situated at the perimeter of said polishing pad and being oriented substantially parallel to said second plurality of structures, and each structure of said third plurality of structures having a longitudinal length that is shorter than that of each structure of said second plurality of structures.

22. The polishing system according to claim 21, wherein each structure of said first, second, and third plurality of structures is concave when viewed in elevational cross-section.

23. The belt polishing pad as defined in claim 21, wherein each structure of said first, second, and third plurality of structures has a hydrophilic substance therein.

24. The polishing system according to claim 21, wherein each structure of said first, second, and third plurality of structures is convex when viewed in elevational cross-section.

25. The polishing system according to claim 16, wherein the polishing machine comprises:

a rotatable polishing platen having said semiconductor substrate mounted on a rotatable polishing head, said semiconductor substrate and said rotatable polishing head being attached to a vertical spindle that is rotatably mounted in a lateral arm that rotates the polishing head, wherein the lateral arm vertically positions the rotatable polishing head to bring the semiconductor substrate into contact with the rotatable polishing head.

26. The polishing system according to claim 16, wherein the polishing pad has an abrasive material fixed therein.

27. A polishing system comprising:

a polishing pad having an abrasive material fixed in the polishing pad, a perimeter, a geometric center, and an external surface thereon, said external surface having therein a plurality of non-planar structures, each said structure having:

a broken arcuate configuration that extends toward the perimeter and toward the geometric center of the polishing pad;

a concave shape when viewed in elevational cross-section; and a hydrophilic substance within the concave shape;

a chemical polishing solution;

a polishing machine for:

placing the polishing pad in contact with a hydrophobic surface of a semiconductor substrate; and moving the semiconductor substrate and the polishing pad in mutual contact to polish the hydrophobic surface on the semiconductor substrate with the polishing pad while wetting the polishing pad and the hydrophobic surface of the semiconductor substrate with the chemical polishing solution.

28. The polishing system as defined in claim 27, wherein the external surface of the polishing pad has a hydrophilic substance thereon.

29. The polishing system as defined in claim 27, wherein said chemical polishing solution has a surface tension, $\gamma_{lg}$, in a range from about 20 dynes/cm to about 50 dynes/cm.

30. A polishing system comprising:

a belt polishing pad including:

an endless perimeter; and an external surface having thereon a hydrophilic substance and a plurality of non-planar structures, each said structure having a linear configuration that is unparallel with respect to the longitudinal perimeter of the belt polishing pad; and a polishing machine to place the polishing pad in contact with a hydrophobic surface of a semiconductor substrate and to move the semiconductor substrate and the polishing pad in mutual contact.

31. The polishing system as defined in claim 30, wherein each said structure is at least one of a depressed line and a raised line.

32. The polishing system as defined in claim 31, wherein each said depressed line has said hydrophilic substance therein.

33. The polishing system according to claim 30, wherein said belt polishing pad is advanced translationally under the hydrophobic surface of a semiconductor substrate.

34. The polishing system according to claim 30, further comprising a chemical polishing solution, wherein the polishing machine wets the belt polishing pad and the hydrophobic surface of the semiconductor substrate with the chemical polishing solution while moving the semiconductor substrate and the belt polishing pad in mutual contact.

35. A polishing system comprising:

an endless belt polishing pad having a perimeter and an external surface that includes a plurality of recesses having a hydrophilic substance therein, each said recess having a linear configuration that is unparallel to the perimeter of the endless belt polishing pad;

a chemical polishing solution; and a polishing machine to place the polishing pad in contact with a hydrophobic surface of a semiconductor substrate and to move the semiconductor substrate and the polishing pad in mutual contact while wetting the polishing pad and the hydrophobic surface of the semiconductor substrate with the chemical polishing solution.

* * * * *

UNITED STATES PATENT AND TRADEMARK OFFICE

CERTIFICATE OF CORRECTION

PATENT NO. : 6,277,015 B1
DATED : August 21, 2001
INVENTOR(S) : Karl M. Robinson and Michael A. Walker It is certified that error appears in the above-identified patent and that said Letters Patent is hereby corrected as shown below:

Column 2,
Line 3, after "pressure" insert -- . --

Column 4,
Line 24, before "hydrophobic" change "an" to -- a --
Line 29, before "hydrophobic" change "an" to -- a --
Line 44, after "order" change "that" to -- to illustrate --

Column 8,
Line 7, after "lines" insert -- , --

Column 9,
Line 9, change "illustrated" to -- illustrative --

Signed and Sealed this

Thirtieth Day of April, 2002

*Attest:*

*Attesting Officer*

JAMES E. ROGAN
*Director of the United States Patent and Trademark Office*